US007050734B2

(12) United States Patent
Kietzman et al.

(10) Patent No.: US 7,050,734 B2
(45) Date of Patent: May 23, 2006

(54) METHOD OF DETERMINING A RELATIVE SPEED BETWEEN INDEPENDENTLY DRIVEN MEMBERS IN AN IMAGE FORMING APPARATUS

(75) Inventors: John William Kietzman, Lexington, KY (US); Calvin Dale Murphy, Lexington, KY (US); Gregory Lawrence Ream, Lexington, KY (US); Brian Anthony Reichert, Lexington, KY (US); Samuel Carter Sipper, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/809,095

(22) Filed: Mar. 25, 2004

(65) Prior Publication Data

US 2005/0214010 A1 Sep. 29, 2005

(51) Int. Cl.
*G03G 15/00* (2006.01)
*G03G 15/20* (2006.01)

(52) U.S. Cl. ..... 399/68; 399/396

(58) Field of Classification Search ..... 399/68, 399/400, 397, 21, 22, 36, 37, 396; 318/45; 271/69, 270, 202

See application file for complete search history.

(56) References Cited

U.S. PATENT DOCUMENTS

| | | | | |
|---|---|---|---|---|
| 4,697,920 | A | | 10/1987 | Palm et al. |
| 4,739,230 | A | | 4/1988 | Sonobe et al. |
| 4,897,778 | A | | 1/1990 | Miyamoto et al. |
| 4,954,863 | A | | 9/1990 | Harada et al. |
| 5,050,859 | A | | 9/1991 | Paxon |
| 5,119,146 | A | * | 6/1992 | Nobumori et al. ..... 399/396 |
| 5,170,215 | A | | 12/1992 | Pfeuffer |
| 5,185,627 | A | | 2/1993 | Hartman |
| 5,363,023 | A | | 11/1994 | Choho |
| 5,467,173 | A | | 11/1995 | Sakata et al. |
| 5,493,374 | A | | 2/1996 | Smith et al. |
| 5,493,378 | A | | 2/1996 | Jamzadeh et al. |
| 5,508,789 | A | | 4/1996 | Castelli et al. |
| 5,519,478 | A | | 5/1996 | Malachowski |
| 5,570,633 | A | * | 11/1996 | Schultz et al. ..... 101/182 |
| 5,574,527 | A | | 11/1996 | Folkins |
| 5,600,424 | A | | 2/1997 | Malachowski |
| 5,623,722 | A | | 4/1997 | Hawley et al. |
| 5,819,149 | A | | 10/1998 | Watanabe et al. |
| 5,983,049 | A | | 11/1999 | Matsuya et al. |
| 6,016,409 | A | | 1/2000 | Beard et al. |
| 6,038,423 | A | | 3/2000 | Tagawa et al. |
| 6,092,803 | A | * | 7/2000 | Munenaka ..... 271/242 |

(Continued)

FOREIGN PATENT DOCUMENTS

JP 62161156 A * 7/1987

*Primary Examiner*—R. Alexander Smith
(74) *Attorney, Agent, or Firm*—Taylor & Aust, P.C.

(57) ABSTRACT

A method of determining a relative speed between two separately driven members in an image forming apparatus, includes the steps of: transporting a print medium using a print media transport assembly including an exit nip, the print media transport assembly operable at a first transport speed; driving a rotatable member associated with an entrance nip using an electric motor at a second transport speed which is independent from the first transport speed; transferring the print medium from the exit nip to the entrance nip; detecting an electrical characteristic of the motor when the print medium is present in each of the exit nip and the entrance nip; and determining a relative speed between the first transport speed and the second transport speed.

27 Claims, 12 Drawing Sheets

U.S. PATENT DOCUMENTS 6,112,037 A * 8/2000 Nagata et al. ..... 399/45
6,122,075 A 9/2000 Yamada et al.
6,154,621 A * 11/2000 Yamamoto et al. ..... 399/68
6,172,696 B1 1/2001 Fujikura et al.
6,259,886 B1 * 7/2001 Ishii et al. ..... 399/388
6,363,228 B1 3/2002 Ream
6,389,240 B1 5/2002 Toyohara et al.
6,483,996 B1 11/2002 Phillips
6,542,703 B1 4/2003 Jung
6,560,434 B1 5/2003 Chapman et al.
6,615,005 B1 9/2003 Maruyama
6,661,981 B1 12/2003 Boothe et al.
6,671,470 B1 12/2003 Suzuki et al.
6,816,685 B1 * 11/2004 Eda ..... 399/16
6,892,038 B1 * 5/2005 Fukutani ..... 399/68
2001/0028807 A1 10/2001 Coleman et al.
2002/0164173 A1 11/2002 Osada
2003/0143003 A1 7/2003 Stringham
2003/0185609 A1 10/2003 Kikuchi et al.
2005/0214010 A1 * 9/2005 Kietzman et al. ..... 399/68
2005/0254847 A1 * 11/2005 Kietzman et al. ..... 399/68
2006/0039727 A1 * 2/2006 Lofthus et al. ..... 399/381
2006/0039728 A1 * 2/2006 deJong et al. ..... 399/381

* cited by examiner

METHOD OF DETERMINING A RELATIVE SPEED BETWEEN INDEPENDENTLY DRIVEN MEMBERS IN AN IMAGE FORMING APPARATUS

BACKGROUND OF THE INVENTION

1. Field of the Invention

The present invention relates to an image forming apparatus, such as an electrophotographic (EP) printer, and, more particularly, to a method of determining a relative speed between two separately driven members in such a printer.

2. Description of the Related Art

Cost and market pressures promote the design of the smallest possible printer with the shortest possible length of paper path. Short paper paths mean that media (especially legal-length media) are involved in more than one operation at once, and may span adjacent components. For example, a piece of paper in a printer which images directly onto paper may be at more than one imaging station while it is also in the fuser at the same time.

Tandem color laser printers which image directly onto paper typically use a paper transport belt to move media past successive imaging stations before fusing the final image onto the media. Velocity variation is a problem created when fuser or machine component tolerances or thermal growth affect the speed ratio between the fuser and the paper transport system upstream from it. Rather than having a constant ratio between the fuser and the paper transport system, this speed ratio varies from machine to machine and from time to time or mode to mode within the same machine. This can cause registration errors, and can cause scrubbing or other print defects as well.

For optimal registration of the imaging planes in tandem color laser printers, the surface speeds of the photoconductors and the media (in a direct-to-paper machine) must be precisely controlled. To achieve this, it is important that no external loads disturb the motor system moving the media. In a hot-roll fuser, the fusing nip is typically a high-force nip, with pressures on the order of 20 psi or more. This high-force nip has a sufficient grip on the media that the fuser will attempt to control the speed of the media regardless of what other systems are regulating its speed. The ability of a fuser to overwhelm other media feeding devices, and the problems this causes, may also be shared by other fuser technologies, such as belt fusers or fusers with belt backup members. For certain types of belt fusers, the backup roll is the driven member, so its effective drive diameter controls the speed of the media.

In direct-to-paper machines, if media is pulled taut between an imaging nip and a fusing nip operating at a higher speed, the disturbance force transmitted via the media from the fuser to the paper transport belt causes image registration errors. To prevent these, the fuser is often under driven so that a media bubble accumulates between the transport belt and the fuser. Since the fuser runs more slowly, the media never becomes taut, so less disturbance force can be transmitted from the fuser to the transport belt. However, the pursuit of small machines means that media bubbles must be constrained to stay as small as possible. If a machine is designed for a certain maximum bubble size, large velocity variations can make the media try to form a bigger bubble. If this happens, the media will probably make contact with machine features which scrape across the image area, causing print defects. The media might also "snap through", from the desired bubble configuration into a new one which is undesirable. This snapping action may also disturb the image and create print defects.

Ideally, the fuser is just slightly under driven so that a small paper bubble develops, but does not occupy much space in the machine. However, many factors affect the relative speeds of the transport belt and the fuser, potentially creating a large range of relative velocity variation. The nominal under drive of the fuser must be set such that the worst-case velocity variation condition still results in fuser under drive or exact speed matching, but never fuser overdrive (which would create taut media).

The speed of the media on a paper transport belt is set by the motion of the transport belt and photoconductive drums which form respective nips with the belt. The speed of the media in the fuser is controlled by the motion of the driven fuser member, roll compliance, drag on the backup roll, and friction coefficients between media and the two fuser rollers. In a hot-roll fuser, the hot roll is usually gear-driven while the backup roll idles on low-friction bearings. Therefore, the surface speed of the hot roll determines the speed of the media in the fuser. In some fuser systems where the backup roll is driven, the speed of that member controls the speed of the media.

The transport speed variances of the fuser can be divided into two primary categories: 1) the effect of temperature variations on the fuser roll, and 2) manufacturing variances such as dimensional tolerances, varying physical properties of materials used in components, different preload nip pressures, etc. Effects of temperature variations of the fuser roll at different operating temperatures are addressed in a manner described in a separate patent application entitled "METHOD OF DRIVING A FUSER ROLL IN AN ELECTROPHOTOGRAPHIC PRINTER", U.S. patent application Ser. No. 10/757,301, filed Jan. 14, 2004, which is assigned to the assignee of the present invention.

Manufacturing variances have been addressed heretofore, but in much more complicated and expensive ways. Merely measuring the outside diameter of a fuser roll and its rotational speed and calculating its circumference or surface speed is not good enough because the roll deforms during rotation. This deformation means that the actual distance media travels during one roll revolution through the fuser is not the same as the circumference of the roll. One method is to place a piece of tape on a fuser roll, and then to fuse solid-coverage images using the fuser roll. The tape causes a print defect at the period of the effective roll circumference, allowing distance traveled during one roll revolution to be accurately measured. The reduction in size of the media as it loses moisture during the fusing process complicates this process, since this change must be accounted for in calculating the period of the print defect. The use of tape is also undesirable since it risks roll damage which could cause later print defects.

U.S. Pat. No. 5,819,149 describes sensing methods for directly monitoring the size of a backup roll in a belt fuser. As the backup roll changes size, its peripheral velocity will change, so the media velocity going through the fuser will also change. Monitoring roll size allows the printer to maintain a desired media speed through the fuser. However, as discussed above, roll circumference will not strictly match the media advance distance during one roll revolution, so this method introduces errors.

U.S. Pat. No. 5,170,215 describes the use of a separate media speed sensor to determine whether a fuser is pulling on continuous-form media. The additional required sensors undesirably increase the cost of the printer.

U.S. Pat. No. 5,508,789 describes a speed measurement method for determining the photoconductor drum speed needed to match speeds between an intermediate transfer belt and the photoconductor drum. The speed of the drum is varied while monitoring current to the drum drive motor, while the belt is driven and servo-actuated independently. Over a long-period speed oscillation (200 seconds), large variations in current demand caused by dry friction between the drum and belt materials when their speeds nearly match are monitored. This dry friction phenomenon provides a large physical response at the point of matching speeds.

Each of these known patented methods uses additional sensors for sensing continuously available parameters or measuring parameters while components are in direct continuous contact. This increases the complexity and cost of related printers.

What is needed in the art is a method of determining and setting a transport speed of a downstream driven member relative to a transport speed of an independent upstream driven member, without requiring additional sensors, etc.

SUMMARY OF THE INVENTION

The present invention provides a method of setting a transport speed of a downstream driven member relative to a transport speed of an upstream driven member by monitoring electrical characteristics of a drive motor for the downstream driven member, rather than utilizing additional sensors, etc.

The invention comprises, in one form thereof, a method of determining a relative speed between two separately driven members in an image forming apparatus, including the steps of: transporting a print medium using a print media transport assembly including an exit nip, the print media transport assembly operable at a first transport speed; driving a rotatable member associated with an entrance nip using an electric motor at a second transport speed which is independent from the first transport speed; transferring the print medium from the exit nip to the entrance nip; detecting an electrical characteristic of the motor when the print medium is present in each of the exit nip and the entrance nip; and determining a relative speed between the first transport speed and the second transport speed.

An advantage of the present invention is that the relative speed between the independently driven members can be determined without additional sensors.

Another advantage is that the transport speed of the downstream member can be set at a predetermined amount less than the upstream member so as to avoid certain print defects.

Yet another advantage is that the point at which the transport speed of the downstream driven member matches the transport speed of the upstream driven member can be established using a threshold value or a linear regression data fit.

A still further advantage is that the method of determining and setting the relative transport speed of the downstream driven member can occur during manufacture or upon replacement of the downstream driven member.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Figure 1:
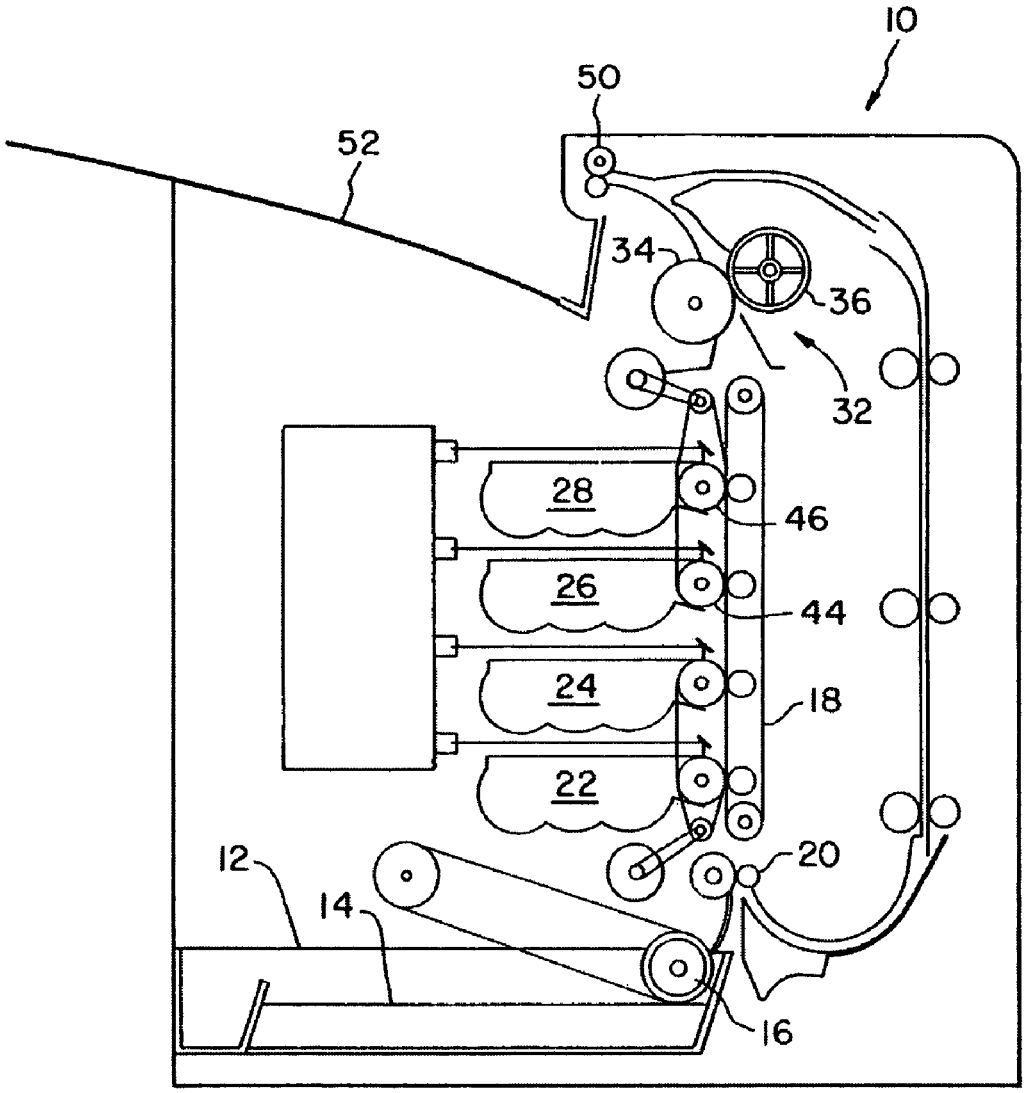
FIG. 1 is a simplified side, sectional view of an EP printer which may be used to carry out an embodiment of the method of the present invention.

Referring now to the drawings and particularly to FIG. 1, there is shown an embodiment of an EP printer 10 of the present invention. Paper supply tray 12 contains a plurality of print media 14, such as paper, transparencies or the like. A print medium transport assembly (not numbered) includes a plurality of rolls and/or transport belts for transporting individual print media 14 through EP printer 10. For example, in the embodiment shown, the print medium transport assembly includes a pick roll 16 and a paper transport belt 18. Pick roll 16 picks an individual print medium 14 from within paper supply tray 12 and transports print medium 14 to a bump-align nip defined in part by roll 20 to paper transport belt 18. Paper transport belt 18 transports the individual print medium past a plurality of color imaging stations 22, 24, 26 and 28 which apply toner particles of a given color to print medium 14 at selected pixel locations. In the embodiment shown, color imaging station 22 is a black (K) color imaging station; color imaging station 24 is a yellow (Y) color imaging station; color imaging station 26 is a magenta (M) color imaging station; and color imaging station 28 is a cyan (C) color imaging station.

Figure 2:
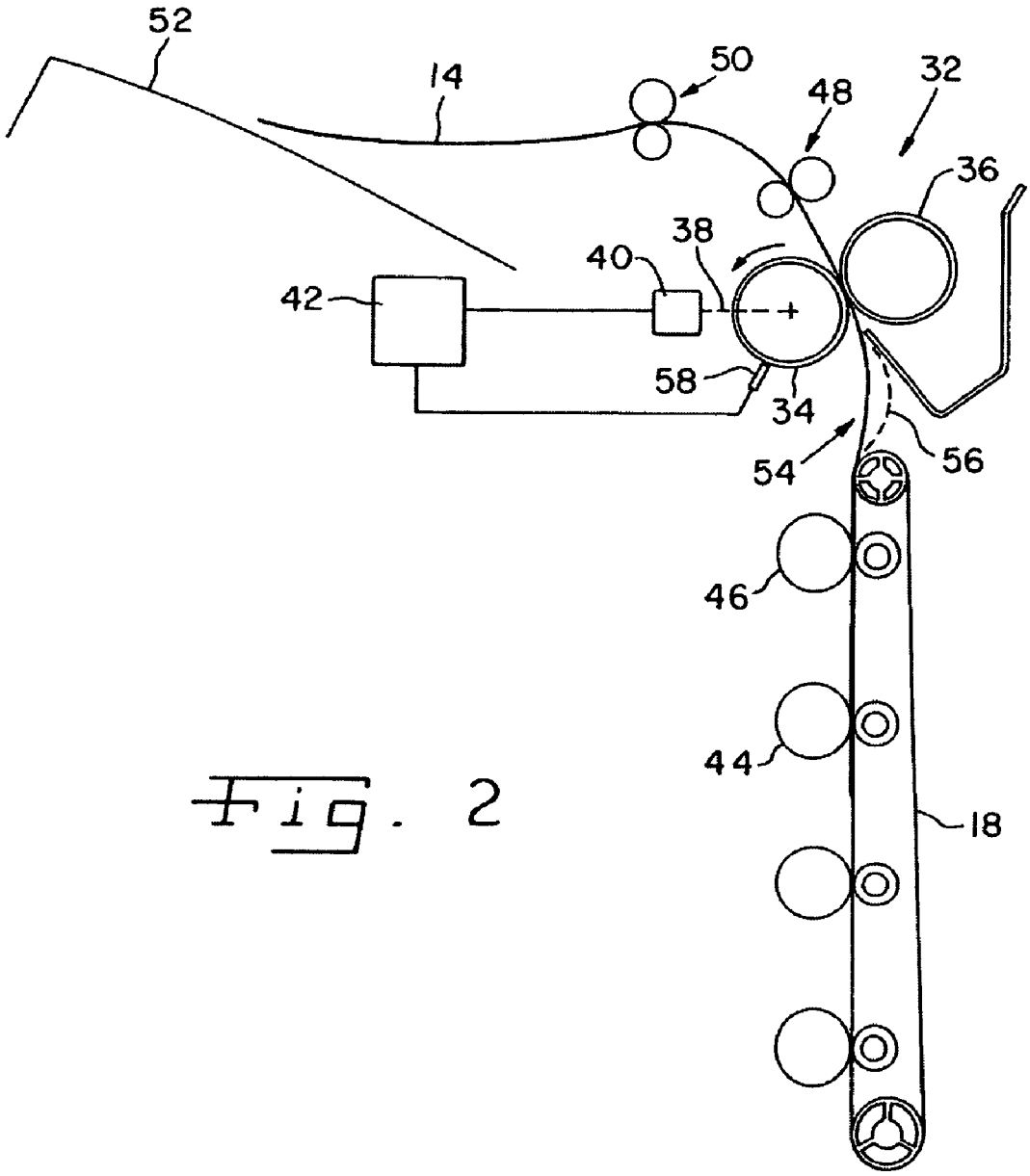
FIG. 2 is a schematic, side view of a portion of the paper transport assembly, fuser and electrical circuit of the EP printer shown in FIG. 1.

Paper transport belt 18 transports an individual print medium 14 (FIG. 2) to fuser 32 where the toner particles are fused to print medium 14 through the application of heat. Fuser 32 includes a hot fuser roll 34 and a back up roll 36. In the embodiment shown, fuser roll 34 is a driven roll and back-up roll 36 is an idler roll; however, the drive scheme may be reversed depending upon the application.

Techniques for the general concepts of heating fuser roll 34 and rotatably driving fuser roll 34 or back-up roll 36 using gears, belts, pulleys and the like (not shown) are conventional and not described in detail herein. Fuser roll 34 is schematically illustrated as being connected via phantom line 38 to drive motor 40, which is in turn connected to and controllably operated by electrical processing circuit 42, such as a microprocessor.

In the embodiment shown, print medium 14 is in the form of a legal length print medium. As is apparent, print medium 14 is concurrently present at the nips defined by a photoconductive (PC) drum 44 of color imaging station 26; a nip defined by PC drum 46 of color imaging station 28; a nip defined between fuser roll 34 and back-up roll 36; a nip defined by fuser exit rolls 48 and a nip defined by machine output rolls 50. The leading edge of print medium 14 is received within output tray 52 on the discharge side of machine output rolls 50.

PC drum 46 and the corresponding backup roll define an exit nip from the print medium transport assembly, and fuser rolls 34 and 36 define an entrance nip to fuser 32. As described above, it is undesirable to overdrive fuser roll 34 such that the fuser-controlled media velocity at the nip of fuser roll 34 exceeds the linear transport speed of paper transport belt 18. The force on the media from the nip between fuser roll 34 and back-up roll 36 typically is larger than the combination of the forces from the nips at PC drums 44 or 46 and the electrostatic force acting on the print medium, and thus the nip pressure and transport speed at fuser roll 34 tend to dominate the transport speed of the print medium conveyed on paper transport belt 18. If fuser roll 34 is overdriven such that the fuser-controlled media velocity is greater than that of paper transport belt 18, then print defects may occur on print medium 14. For this reason, fuser roll 34 may be under driven to cause a slight bubble 54 in the gap between the discharge side of paper transport belt 18 and the input side of the nip between fuser roll 34 and back-up roll 36. This bubble 54 may be more pronounced, as illustrated by phantom line 56 in FIG. 2. If the size of bubble 54 becomes too large because of the velocity differences between fuser roll 34 and paper transport belt 18, then print medium 14 may contact physical features within printer 10 resulting in print defects. That is fuser roll 34 should be under driven, but not to such an extent that defects resulting from scraping, etc. of print medium 14 occur.

In the embodiment shown, each of fuser roll 34 and back-up roll 36 have a PFA sleeve at the outside diameter over an elastomeric layer. The outside diameter of fuser roll 34 and back-up roll 36 is approximately 36 mm at the outside diameter of the PFA sleeve when measured cold. It will be appreciated that the outside diameter of fuser roll 34 increases as the operating temperature of fuser roll 34 increases.

According to an aspect of the present invention, the relative speeds between fuser roll 34 and transport belt 18 are measured to determine a desired nominal fuser speed in printer 10. This method is carried out at the end of the printer manufacturing line, and is necessary if a fuser is replaced in the field. The method of the present invention accounts for manufacturing tolerances on fuser rolls which affect the speed of the media (such as paper 14) as it passes through fuser 32. This measurement operation allows the relative speed between fuser 32 and transport belt 18 to be set in the middle of an acceptable range, so that media 14 will build an optimal paper bubble 54 between the two systems. Otherwise, during some operating modes, fuser 32 pulls media 14 too tight and affects color registration, or it slows down too much during other modes and builds too large of a paper bubble 56, possibly causing tailflip and image smear.

More particularly, one method of determining a relative speed between fuser 32 and transport belt 18 is to monitor commanded voltage of motor 40 while sending pages through fuser 32 at different speeds. A speed control feedback system inside printer 10 tries to maintain motor 40 at a constant commanded velocity. In order to do that, it monitors a fuser motor encoder and changes the commanded voltage applied to motor 40 to assure that the encoder and motor 40 are rotating at a consistent speed. When the load on motor 40 rises and its speed drops slightly, the speed control system raises the commanded voltage in order to restore the speed to the commanded value. The commanded voltage is generated by the electrical processor 42 within printer 10 as a pulse-width-modulation (PWM) duty-cycle setting which reduces the 24V motor supply voltage to a time-averaged intermediate voltage to drive motor 40. This duty-cycle PWM setting can be monitored by processor 42 to assess the load on motor 40.

Except when a sheet of media 14 is on both transport belt 18 and in the fuser nip between rolls 34 and 36, media 14 applies very little load to motor 40. Most of the fuser motor power is used to rotate fuser rolls 34 and 36 (which deform against one another as they rotate under load), fuser exit rolls 48 and machine output rolls 50. Even when a sheet 14 is on both transport belt 18 and in the fuser nip, if the media speed in fuser 32 is slower than the transport belt speed, a paper bubble 54 will develop, and little additional load will be imposed on motor 40. However, if a sheet is on both transport belt 18 and in the fuser nip, and the media speed in fuser 32 is faster than the independently driven transport belt speed, then fuser 32 will pull on media 14 and transport belt 18, raising the load on motor 40. During normal operation, this is not desirable since the load on transport belt 18 could lead to color registration errors. However, during a speed measurement sequence of the present invention, this additional load can be monitored using the PWM setting of motor 40. The presence or absence of this additional load, depending upon the relative speeds of transport belt 18 and fuser 32, can be used to determine when the speeds are matched. With a known fuser speed which matches the transport belt speed, processor 42 adds an offset to slow fuser 32 so that a desired paper bubble is created, and the resulting sum is stored as a nominal fuser speed.

Figure 7:
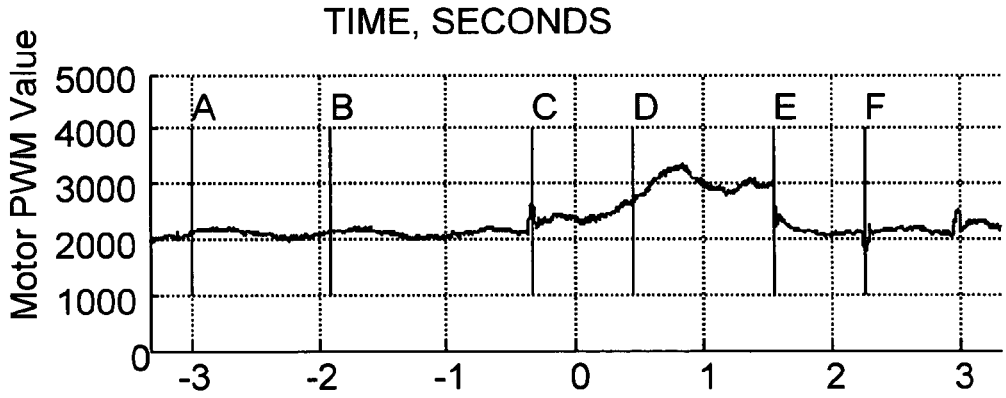
FIG. 7 is a graphical illustration of pulse width modulation settings corresponding to load on a fuser motor, at a fuser speed of approximately 107.540 mm/sec.

This can be more easily explained via a graph of the fuser motor PWM setting (representing fuser load) and the fuser motor speed as a medium 14 passes through fuser 32. FIGS. 3–7 illustrate various PWM settings at different fuser speeds. FIG. 7 is a graphical illustration at the fastest fuser speed and thus provides the most pronounced response for the examples shown in FIGS. 3–7. Since FIG. 7 is also the easiest to visualize, it is initially used for illustration purposes herein.

Figure 3:
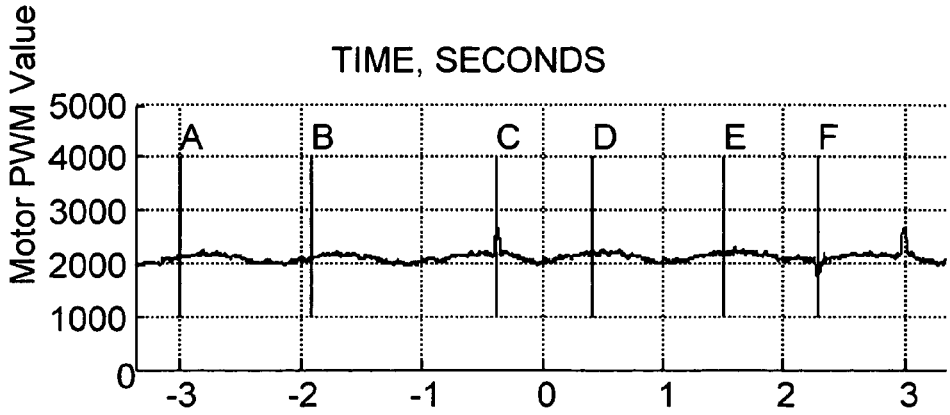
FIG. 3 is a graphical illustration of pulse width modulation settings corresponding to load on a fuser motor, at a fuser speed of approximately 104.991 mm/sec.
Figure 4:
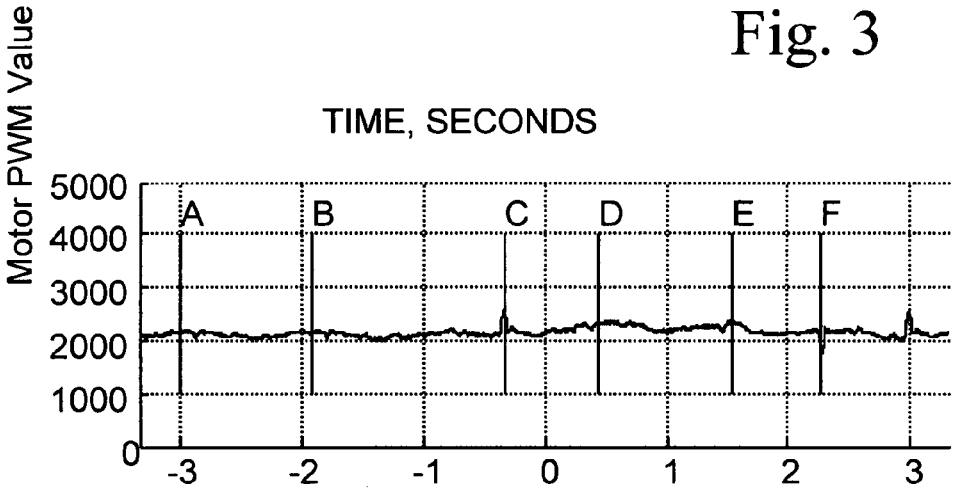
FIG. 4 is a graphical illustration of pulse width modulation settings corresponding to load on a fuser motor, at a fuser speed of approximately 106.647 mm/sec.
Figure 5:
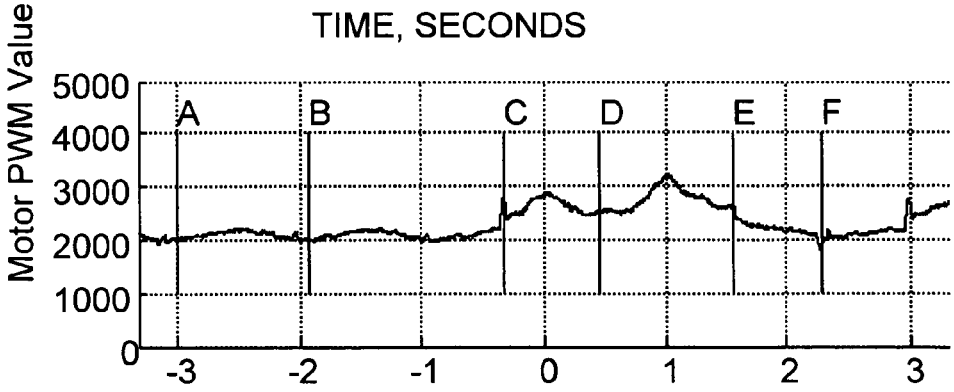
FIG. 5 is a graphical illustration of pulse width modulation settings corresponding to load on a fuser motor, at a fuser speed of approximately 107.030 mm/sec.
Figure 6:
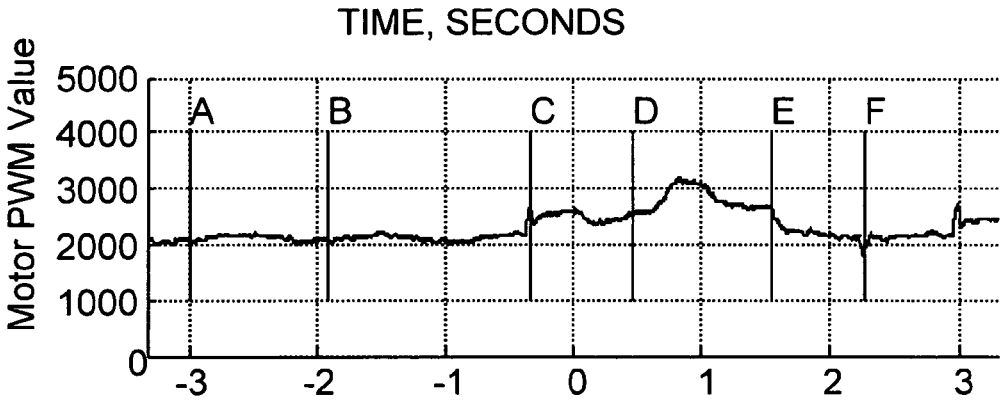
FIG. 6 is a graphical illustration of pulse width modulation settings corresponding to load on a fuser motor, at a fuser speed of approximately 107.284 mm/sec.

FIG. 7 illustrates a relatively fast fuser speed setting (107.540 mm/sec), with fuser 32 pulling on transport belt 18 via print media 14. The fuser motor PWM settings can range between 0 and 4095, where higher numbers indicate voltage is being applied to motor 40 a greater percentage of the PWM period, thus providing higher average voltages to motor 40. The higher voltages indicate a higher load on the fuser drive motor as previously described. The graph in FIG. 7 represents empirical data recorded during the first page of a multi-page job, with the spike at +3.0 seconds being the leading edge of a following media 14 entering fuser 32. Various events in FIG. 3 are labeled A through F in Table 1 below:

TABLE 1

| Event timing labels in FIGS. 3–7 for fuser motor PWM and speed graphs | |
|---|---|
| A = | Start of measurement period for "No-Paper PWM average"; |
| B = | End of measurement period for "No-Paper PWM average"; |
| C = | Paper leading edge enters fuser nip; |
| D = | Start of measurement period for "With-Paper PWM average"; |
| E = | Paper trailing edge exits last transfer nip; end of measurement period for "With-Paper PWM average"; and |
| F = | Paper trailing edge exits fuser nip. |

The method of the present invention is initiated from either an electronic signal over an interface cable or by an operator input menu of printer 10, either after printer manufacture and color registration, or after a field replacement of fuser 32. Fuser 32 must be at the nominal operating temperature. The sequence consists of the printing of a number of media 14 (e.g., around six), at progressively faster fuser speeds. The first fuser speed is chosen to be significantly slower (e.g. 1% slower) than the transport belt speed, so that media 14 will not exert any additional load on fuser 32. During the printing of each media 14, the important measurement interval is the period of time when the page is both attached to transport belt 18 and also in the fuser nip. During this time, the fuser motor PWM setting is averaged over one revolution of fuser rolls 34 and 36. This average PWM level is compared to an earlier average PWM level, measured during one revolution of fuser rolls 34 and 36 before the media entered fuser 32. The difference between these two average PWM levels quantifies the effect of media 14 on the fuser motor load at this slow fuser speed. This value is stored.

Next, the measurement is repeated at successively faster speeds, at a nominal interval of 0.25% fuser speed increase per page. The effect of media 14 on the fuser motor load is measured and computed the same way for each speed (see, e.g., Table 2). Preferably, the later pages are printed slower-to-faster because a media transport speed which is too fast might risk motor over-current, causing a machine error which would interrupt the process. By operating slower-to-faster, the sequence can be stopped if motor current demands exceed a threshold below that which would cause an error.

TABLE 2

Speed measurement via PWM settings

| Actual Fuser Speed (mm/sec) | No-Paper Fuser PWM (avg counts) | With-Paper Fuser PWM (avg counts) | PWM Increase (%) |
|---|---|---|---|
| 104.991 | 2089 | 2126 | 1.8 |
| 106.647 | 2108 | 2266 | 7.5 |
| 107.030 | 2101 | 2769 | 31.8 |
| 107.285 | 2112 | 2813 | 33.2 |
| 107.540 | 2106 | 3012 | 43.0 |

Graphs of the fuser motor PWM settings and fuser motor speeds are shown in FIGS. 3–7. The same labels shown in Table 1 apply, with the motor PWM setting averages computed during the timing windows indicated in Table 1. As is apparent, as fuser speed is increased, there is a progressive increase in the amount of influence from transport belt 18, requiring additional fuser motor power, as quantified by the increase in the average PWM.

Two methods may be used to detect an approximate matched speed between fuser 32 and transport belt 18. One method applies a threshold to the PWM increase. For example, if 15% is set as a threshold value, then the illustrated transport speed of 106.647 mm/s is the matched speed, because it is the last speed point below the threshold PWM increase. Alternately, it is possible to interpolate between 106.647 mm/s and 107.030 mm/s to find the speed for exactly a 15% PWM increase, obtaining 106.765 mm/s.

Another method of detecting an approximate matched speed uses linear regression and more of the data to find an intercept value. For example, referring to Table 2, normalize the PWM increase percentages by subtracting the PWM increase at the lowest speed. That power increase is likely due to the presence of paper 14 in the fuser nip, rather than any drag of transport belt 18 on fuser 32. Second, fit a line to the PWM increase data and estimate the lowest fuser speed which does not require any increase in PWM values. The data is shown in Table 3:

TABLE 3

Speed measurement via PWM settings

| Actual Fuser Speed (mm/sec) | PWM Increase (%) | Normalized PWM Increase (%) |
|---|---|---|
| 104.991 | 1.8 | 0.0 |
| 106.647 | 7.5 | 5.7 |
| 107.030 | 31.8 | 30.0 |
| 107.285 | 33.2 | 31.4 |
| 107.540 | 43.0 | 41.2 |

Figure 8:
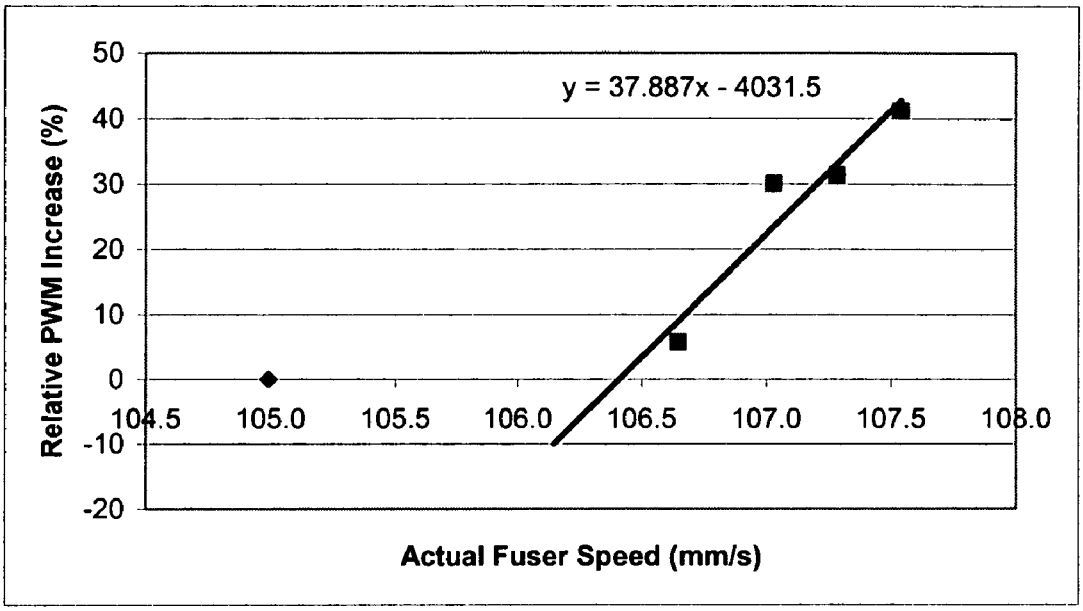
FIG. 8 is a graphical illustration of a linear regression data fit to determine an approximate matching speed between the fuser and transport belt.

This data and the resulting line are plotted in FIG. 8. The intercept of the line is 106.41 mm/s, the estimated fuser speed to match the transport belt speed. Using the fuser speed which matches the speed of the transport belt, the nominal fuser speed is set about 0.75% slower than this speed, to put the nominal paper bubble in the middle of the range of its possible sizes.

The method of the present invention can also detect other electrical characteristics of motor 40. For example, this method can also be used with the signals from the fuser motor encoder. When a media 14 leaves transport belt 18 so that it is only in the fuser nip, a dramatic reduction in the fuser motor load occurs, which results in a brief over-speed condition on motor 40. The resulting speed spike can be detected by monitoring the fuser encoder output. Either the rate of encoder pulses or transitions or the period between the pulses or transitions can be monitored to find the size of this spike, which is greater when motor 40 is driving the print media at a velocity that is faster than the transport belt. While this event is one of the few that the motor encoder output could be used to monitor, the same spike could also be monitored via motor current or motor PWM setting.

Further, the method of the present invention as described above for determining a relative speed between two separately and independently driven members in an image forming apparatus may be used with independently driven members other than a fuser and a paper transport assembly. For example, a print medium may be transported from an exit nip of an upstream and independently driven bump-align motor to the entry nip of a transport belt. The present invention allows the relative speed between the transport speed at the exit nip of the upstream bump-align motor and the entry nip of a transport belt to be determined, and an adjustment made to one or both transport speeds, if necessary.

Both bump-align and fuser interfaces to a transport belt may be measured in concert as long as print media is not in both bump-align and fuser nips simultaneously. The effect on the bump-align motor voltage can be determined while a page is in the bump-align nip and on the transport belt, but before the page enters the fuser nip. After the same page leaves the bump-align nip, the effect on the fuser motor voltage can be determined while the page is on the transport belt and in the fuser nip. During the measurement process, the successive pages printed at different speeds must be separated by large enough interpage gaps to ensure that a previous page has left the transport belt before a following page reaches the transport belt.

Figure 9A:
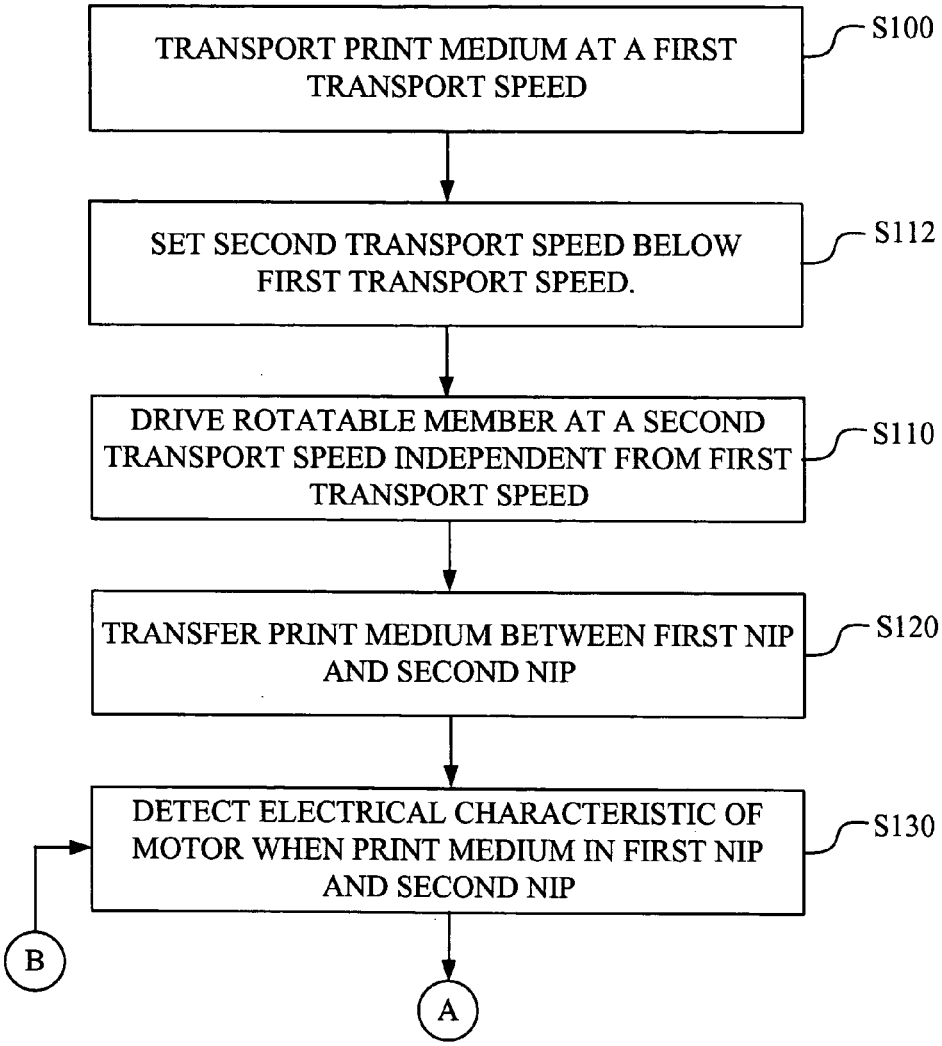
FIGS. 9A–10 are flowcharts illustrating an embodiment of a method according to the present invention.
Figure 9B:
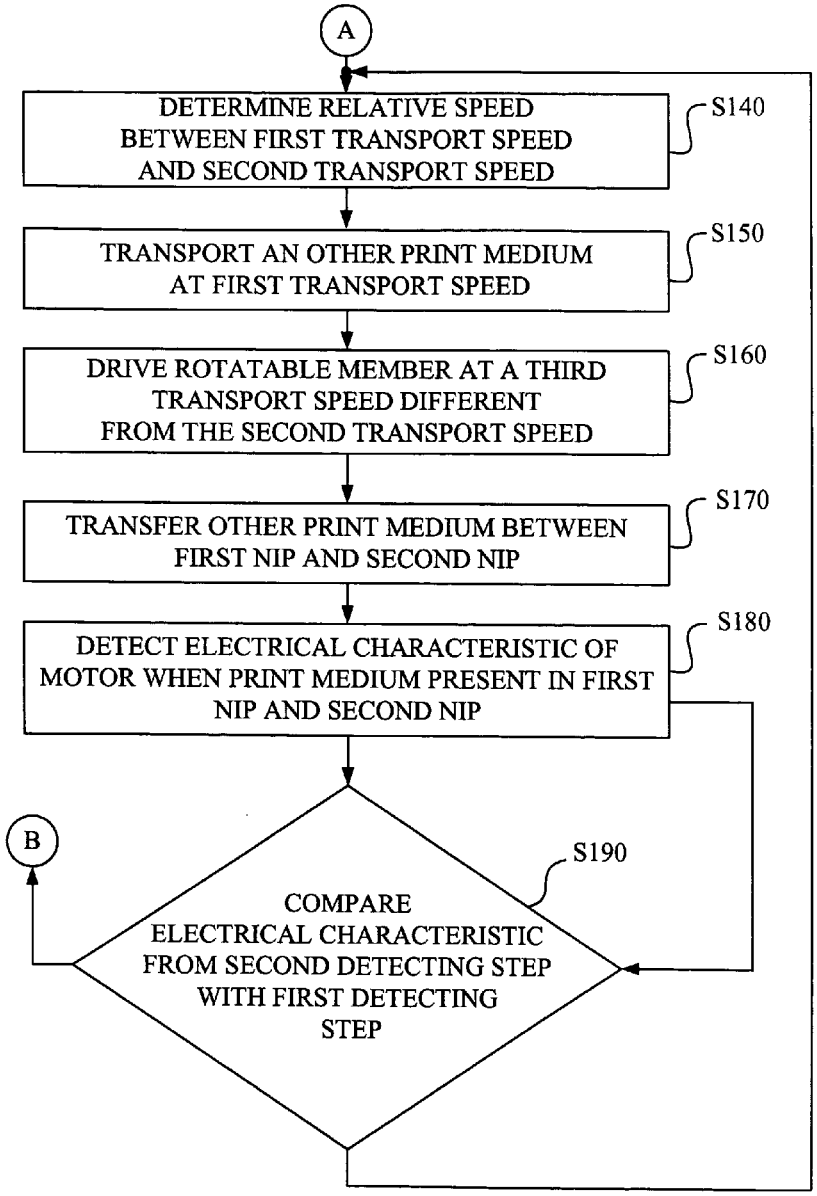
Figure 10:
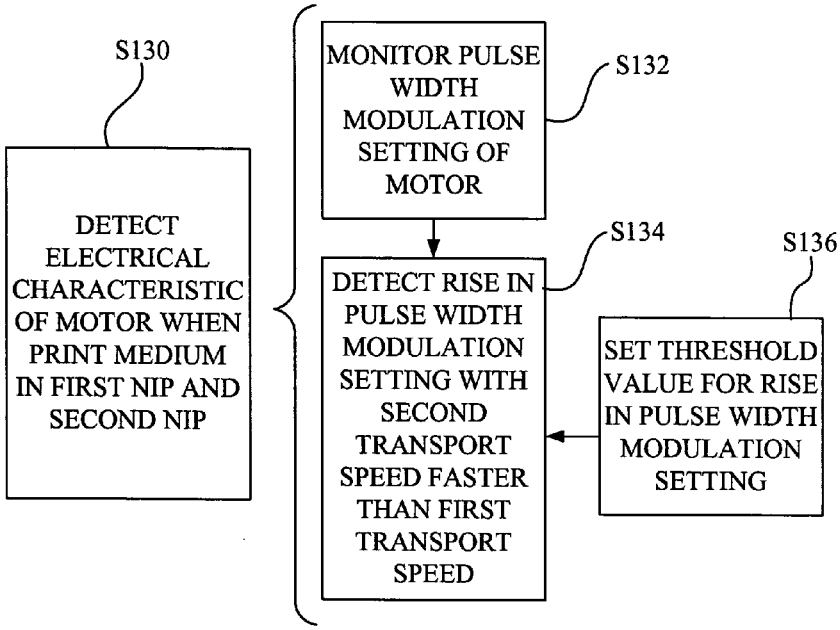

With reference to FIGS. 9A–10, the present invention discloses a method of determining a relative speed between two separately driven members in an image forming apparatus, including the steps of: transporting (S100) a print medium using a print media transport assembly including a first nip, the print media transport assembly operable at a first transport speed; driving (S110) a rotatable member associated with a second nip using an electric motor at a second transport speed which is independent from the first transport speed; transferring (S120) the print medium between the first nip and the second nip; detecting (S130) an electrical characteristic of the motor when the print medium is present in each of the first nip and the second nip; and determining (S140) a relative speed between the first transport speed and the second transport speed. The method can further include the steps of, prior to the determining step (S140): transporting (S150) an other print medium using the print media transport assembly at the first transport speed; driving (S160) the rotatable member using the electric motor at a third transport speed which is different from the second transport speed; transferring (S170) the other print medium between the first nip and the second nip; detecting (S180) the electrical characteristic of the motor when the print medium is present in each of the first nip and the second nip; and comparing (S190) the electrical characteristic from the second detecting step with the electrical characteristic from the first detecting step; wherein the determining step (S140) is dependent upon the comparing step (S190). The method can include the step of setting (S112) the second transport speed at a predetermined value below the first transport speed. The second transport speed can be set in step S112 at a value which is approximately 0.75% less than the first transport speed. The detecting step (S130) can include the substeps of: monitoring (S132) a pulse width modulation setting of the motor; and detecting (S134) a rise in the pulse width modulation setting associated with the second transport speed being faster than the first transport speed. The method can further include the substep of setting (S136) a threshold value for the rise in pulse width modulation setting. The threshold value can be set in step S136 at an approximately 15% rise in the pulse width modulation setting.

Figure 11A:
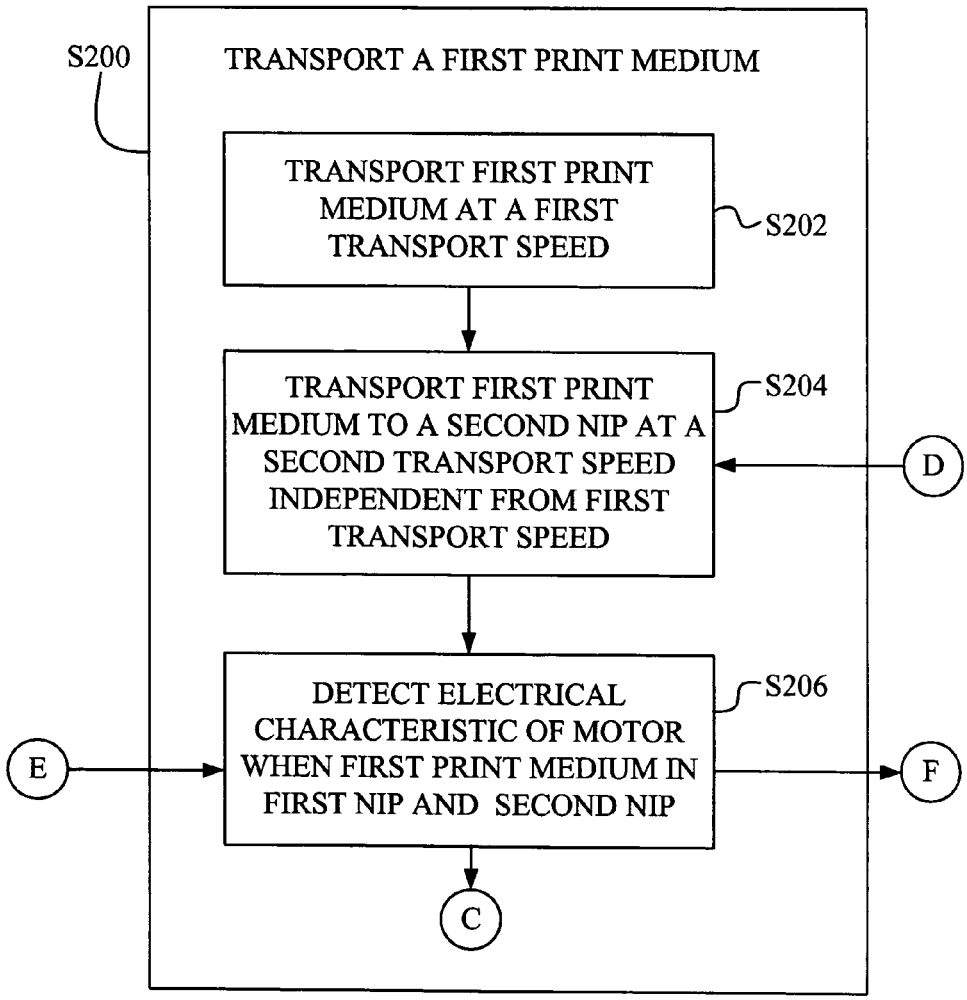
FIGS. 11A–11C are flowcharts illustrating another embodiment of a method according to the present invention.
Figure 11B:
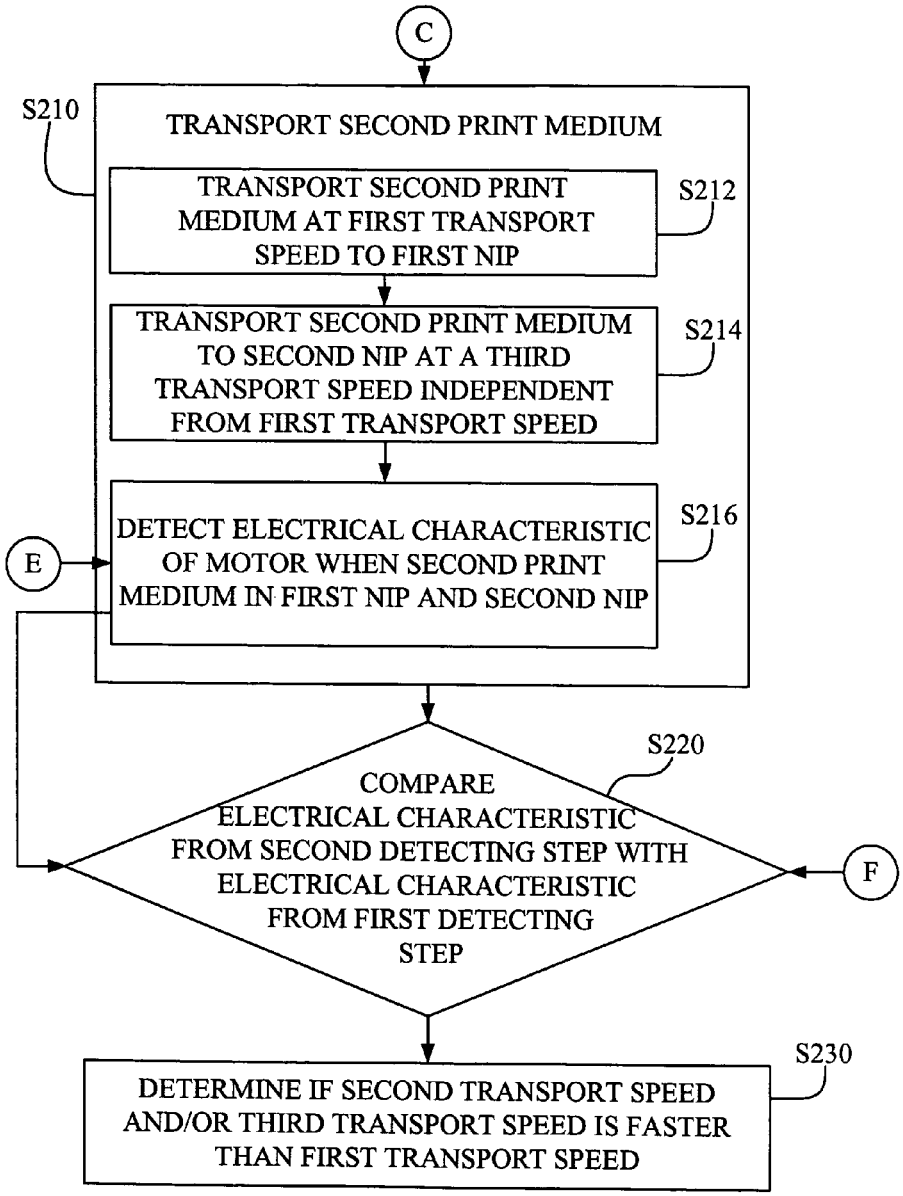
Figure 11C:
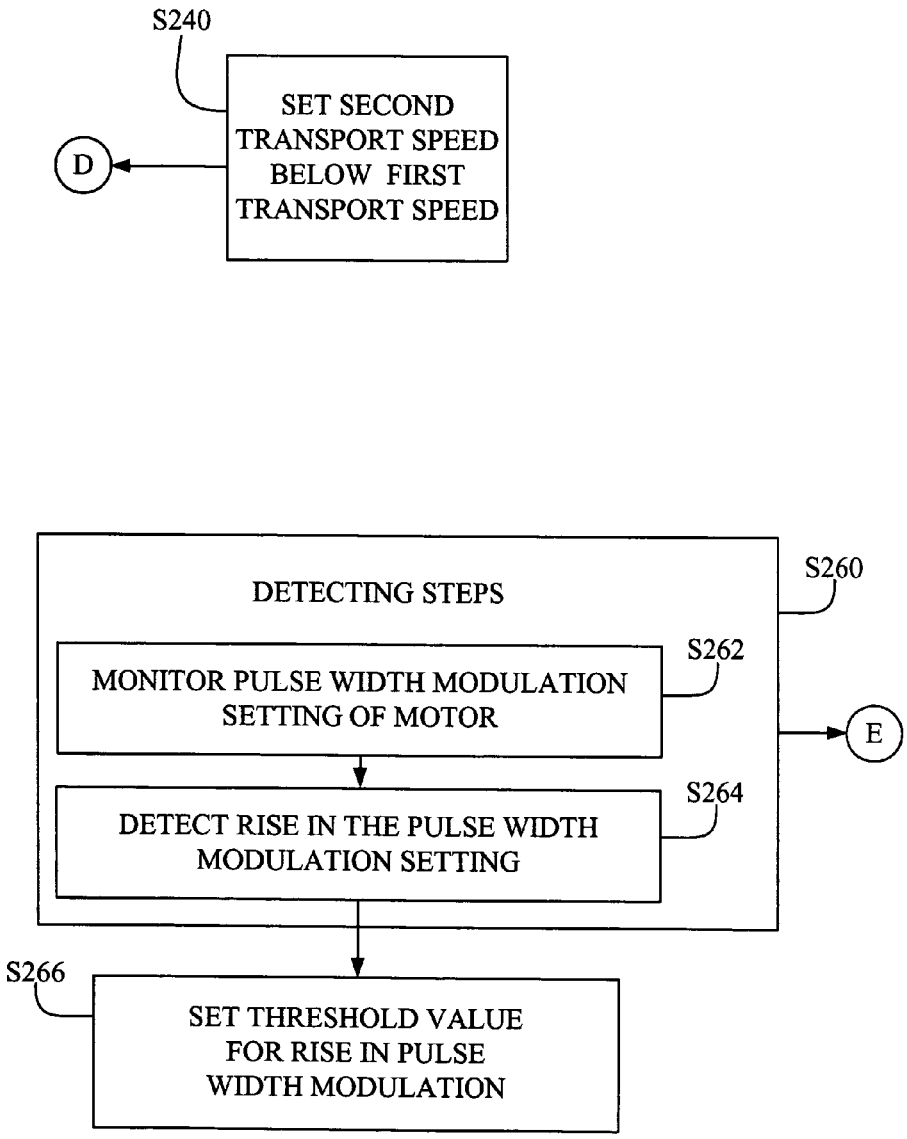

With reference to FIGS. 11A–C, the present invention discloses a method of operating an image forming apparatus, including the steps of: transporting (S200) a first print medium, comprising the substeps of: transporting (S202) the first print medium using a print media transport assembly at a first transport speed to a first nip; transporting (S204) the first print medium to a second nip at a second transport speed associated with an electric motor, the second transport speed being independent from the first transport speed; detecting (S206) an electrical characteristic of the motor when the first print medium is present in each of the first nip and the second nip; and transporting (S210) a second print medium, including the substeps of: transporting (S212) the second print medium using the print media transport assembly at the first transport speed to the first nip; transporting (S214) the second print medium to the second nip at a third transport speed associated with the electric motor, the third transport speed being independent from the first transport speed; detecting (S216) an electrical characteristic of the motor when the second print medium is present in each of the first nip and the second nip; comparing (S220) the electrical characteristic from the second detecting step (S216) with the electrical characteristic from the first detecting step (S206); determining (S230) whether at least one of the second transport speed and the third transport speed is faster than the first transport speed. The method can include the step of setting (S240) the second transport speed at a predetermined value below the first transport speed. The second transport speed can be set in step S240 at a value which is approximately 0.75% less than the first transport speed. The detecting steps can include the substeps (S260) of: monitoring (S262) a pulse width modulation setting of the motor; and detecting (S264) a rise in the pulse width modulation setting. The method further include the substep of setting (S266) a threshold value for the rise in pulse width modulation setting. The threshold value can be set in step S266 at a 15% rise in the pulse width modulation setting.

Figure 12:
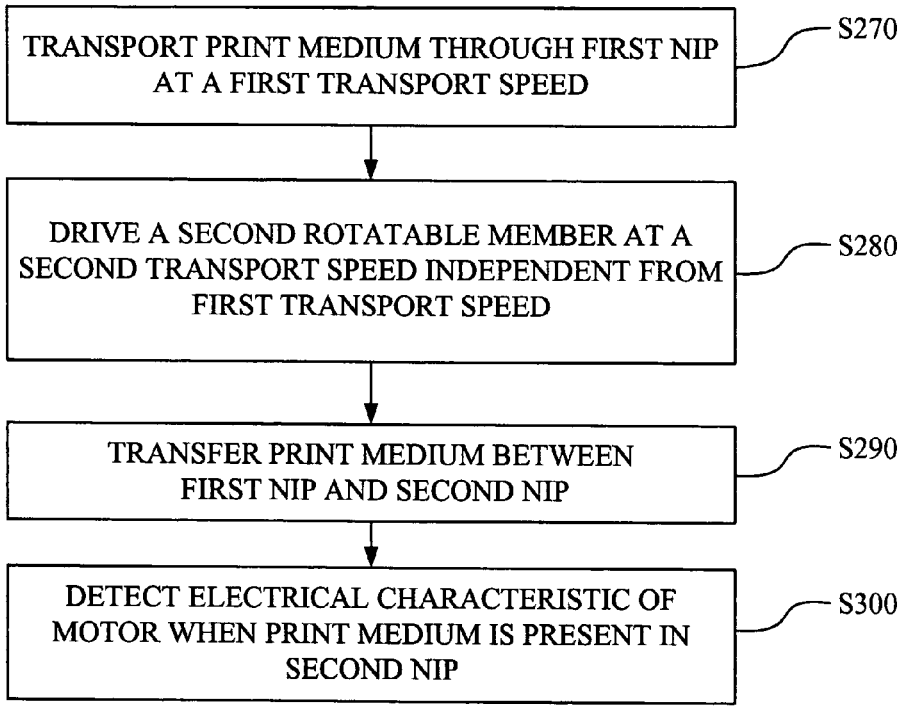
FIG. 12 is a flowchart illustrating another embodiment of a method according to the present invention.

With reference to FIG. 12, the present invention discloses a method of operating an electrophotographic printer, including the steps of: transporting (S270) a print medium through a first nip at a first transport speed using a first rotatable member; driving (S280) a second rotatable member associated with a second nip using an electric motor at a second transport speed which is independent from the first transport speed; transferring (S290) the print medium between the first nip and the second nip; and detecting (S300) an electrical characteristic of the motor when the print medium is present in the second nip.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of determining a relative speed between two separately driven members in an image forming apparatus, comprising the steps of:

transporting a print medium using a print media transport assembly including a first nip, said print media transport assembly operable at a first transport speed;

driving a rotatable member associated with a second nip using an electric motor at a second transport speed which is independent from said first transport speed;

transferring the print medium between said first nip and said second nip;

detecting an electrical characteristic of said motor when the print medium is present in each of said first nip and said second nip; and determining a relative speed between said first transport speed and said second transport speed.

2. The method of claim 1, including the steps of, prior to said determining step:

transporting an other print medium using said print media transport assembly at said first transport speed;

driving said rotatable member using said electric motor at a third transport speed which is different from said second transport speed;

transferring the other print medium between said first nip and said second nip;

detecting said electrical characteristic of said motor when the print medium is present in each of said first nip and said second nip; and comparing said electrical characteristic from said second detecting step with said electrical characteristic from said first detecting step;

wherein said determining step is dependent upon said comparing step.

3. The method of claim 2, wherein said detecting steps include the substep of:

monitoring a pulse width modulation setting of said motor for each of said first detecting step and said second detecting step;

the method further includes a step of calculating a numerical analysis data fit using a rise in said pulse width modulation setting associated with each of said first detecting step and said second detecting step; and wherein said determining step is dependent upon said calculated data fit.

4. The method of claim 3, wherein said data fit is a linear regression data fit.

5. The method of claim 1, including the step of setting said second transport speed at a predetermined value below said first transport speed.

6. The method of claim 5, wherein said second transport speed is set at a value which is approximately 0.75% less than said first transport speed.

7. The method of claim 1, wherein said detecting step includes the substeps of:

monitoring a pulse width modulation setting of said motor;

detecting a rise in said pulse width modulation setting associated with said second transport speed being faster than said first transport speed.

8. The method of claim 7, including the further substep of setting a threshold value for said rise in pulse width modulation setting.

9. The method of claim 8, wherein said threshold value is set at an approximately 15% rise in said pulse width modulation setting.

10. The method of claim 1, wherein said detecting step includes the substep of monitoring one of a pulse width modulation setting of said motor, an electrical current supplied to said motor, and an encoder speed associated with said motor.

11. The method of claim 1, wherein said motor comprises one of a fuser motor located downstream from said first nip, and a bump-align motor located upstream from said first nip.

12. The method of claim 1, wherein said rotatable member comprises one of a fuser roll and a bump-align roll.

13. The method of claim 1, wherein said first nip is defined in part by a print media transport belt.

14. The method of claim 1, wherein said paper transport assembly and said rotatable member are mechanically decoupled.

15. A method of operating an image forming apparatus, comprising the steps of:

transporting a first print medium, comprising the substeps of:

transporting the first print medium using a print media transport assembly at a first transport speed to a first nip;

transporting the first print medium to a second nip at a second transport speed associated with an electric motor, said second transport speed being independent from said first transport speed;

detecting an electrical characteristic of said motor when the first print medium is present in each of said first nip and said second nip; and transporting a second print medium, comprising the substeps of:

transporting the second print medium using said print media transport assembly at said first transport speed to said first nip;

transporting the second print medium to said second nip at a third transport speed associated with said electric motor, said third transport speed being independent from said first transport speed;

detecting an electrical characteristic of said motor when the second print medium is present in each of said first nip and said second nip;

comparing said electrical characteristic from said second detecting step with said electrical characteristic from said first detecting step;

determining whether at least one of said second transport speed and said third transport speed is faster than said first transport speed.

16. The method of claim 15, wherein said detecting steps include the substeps of:

monitoring a pulse width modulation setting of said motor for each of said first detecting step and said second detecting step; and calculating a numerical analysis data fit using a rise in said pulse width modulation setting associated with each of said first detecting step and said second detecting step; and wherein said determining step is dependent upon said calculated data fit.

17. The method of claim 16, wherein said data fit is a linear regression data fit.

18. The method of claim 15, including the step of setting said second transport speed at a predetermined value below said first transport speed.

19. The method of claim 18, wherein said second transport speed is set at a value which is approximately 0.75% less than said first transport speed.

20. The method of claim 15, wherein said detecting steps include the substeps of:

monitoring a pulse width modulation setting of said motor; and detecting a rise in said pulse width modulation setting.

21. The method of claim 20, including the further substep of setting a threshold value for said rise in pulse width modulation setting.

22. The method of claim 21, wherein said threshold value is set at a 15% rise in said pulse width modulation setting.

23. The method of claim 15, wherein said detecting step includes the substep of monitoring one of a pulse width modulation setting of said motor, an electrical current supplied to said motor, and an encoder speed associated with said motor.

24. The method of claim 15, wherein said motor comprises one of a fuser motor located downstream from said first nip, and a bump-align motor located upstream from said first nip.

25. The method of claim 15, further including a rotatable member defining one of said first nip and said second nip, said rotatable member comprising one of a fuser roll and a bump-align motor.

26. The method of claim 15, wherein said first nip is defined in part by a print media transport belt.

27. A method of operating an electrophotographic printer, comprising the steps of:

transporting a print medium through a first nip at a first transport speed using a first rotatable member;

driving a second rotatable member associated with a second nip using an electric motor at a second transport speed which is independent from said first transport speed;

transferring the print medium between said first nip and said second nip; and detecting an electrical characteristic of said motor when the print medium is present in said second nip.

* * * * *